US009817356B2

(12) United States Patent
Kurosu

(10) Patent No.: US 9,817,356 B2
(45) Date of Patent: Nov. 14, 2017

(54) IMAGE FORMING SYSTEM, IMAGE FORMING APPARATUS, AND POST-PROCESSING APPARATUS

(71) Applicant: Konica Minolta, Inc., Chiyoda-ku, Tokyo (JP)

(72) Inventor: Shigetaka Kurosu, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/968,281

(22) Filed: Dec. 14, 2015

(65) Prior Publication Data

US 2016/0187846 A1 Jun. 30, 2016

(30) Foreign Application Priority Data

Dec. 25, 2014 (JP) ..... 2014-263478

(51) Int. Cl.
*G03G 15/00* (2006.01)

(52) U.S. Cl.
CPC . *G03G 15/6573* (2013.01); *G03G 2215/0067* (2013.01)

(58) Field of Classification Search
CPC ..... G03G 21/203; G03G 15/6573–15/6585; G03G 2215/00426
See application file for complete search history.

(56) References Cited

U.S. PATENT DOCUMENTS 3,826,379 A * 7/1974 Wright ..... G03G 15/6552 271/193
6,052,553 A * 4/2000 Acquaviva ..... G03G 15/6573 399/341
2005/0030694 A1* 2/2005 Morioka ..... H05F 3/04 361/212
2007/0240640 A1* 10/2007 Shida ..... B65H 37/00 118/258

(Continued)

FOREIGN PATENT DOCUMENTS

JP H09-110269 A 4/1997
JP A-H10-181969 7/1998

(Continued)

OTHER PUBLICATIONS

Notice of Reason for Refusal dated Dec. 20, 2016 for JP Application No. 2014-263478 with English translation, total of 14 pages.

(Continued)

*Primary Examiner* — Clayton E Laballe
*Assistant Examiner* — Ruifeng Pu
(74) *Attorney, Agent, or Firm* — Squire Patton Boggs (US) LLP

(57) ABSTRACT

The image forming system includes an image forming apparatus and a post-processing apparatus, wherein the image forming apparatus has a fixing unit configured to heat and press a recording sheet with a transferred toner image to fix the toner image to the recording sheet, and the post-processing apparatus has a humidifying unit configured to humidify the recording sheet with the toner image fixed by (Continued)

the fixing unit, and a voltage applying unit configured to apply a bias voltage to the recording sheet humidified by the humidifying unit.

15 Claims, 4 Drawing Sheets

(56) References Cited

U.S. PATENT DOCUMENTS

2007/0242987 A1* 10/2007 Shida ..... B65H 37/00 399/320
2007/0264067 A1* 11/2007 Shida ..... G03G 15/6576 399/406
2009/0016794 A1* 1/2009 Yahata ..... G03G 15/6541 399/405
2009/0110460 A1* 4/2009 Shida ..... G03G 15/6573 399/406
2009/0245908 A1* 10/2009 Shida ..... G03G 15/6576 399/407
2009/0317160 A1* 12/2009 Kougami ..... G03G 15/6576 399/406
2012/0045265 A1* 2/2012 Zaretsky ..... G03G 15/6573 399/405
2012/0082492 A1* 4/2012 Park ..... G03G 15/6573 399/324
2012/0099911 A1* 4/2012 Zaretsky ..... G03G 15/6573 399/406
2012/0114402 A1* 5/2012 Hatazaki ..... G03G 15/6573 399/341
2012/0287450 A1 11/2012 Nishi
2013/0331246 A1 12/2013 Kamiya et al.
2014/0079419 A1* 3/2014 Itani ..... G03G 15/0266 399/50
2015/0001784 A1* 1/2015 Sekigawa ..... B65H 39/00 270/58.08
2016/0187803 A1* 6/2016 Matsudaira ..... G03G 15/0266 399/341
2016/0191733 A1* 6/2016 Konishi ..... G03G 15/70 358/1.12

FOREIGN PATENT DOCUMENTS

JP A-2004-10240 1/2004
JP 2007-279550 A 10/2007
JP 2009-035379 A 2/2009
JP 2009-196774 A 9/2009
JP 2012-237924 12/2012
JP 2013-227088 A 11/2013
JP 2013-256339 A 12/2013

OTHER PUBLICATIONS

Decision of Refusal dated Apr. 4, 2017 for JP Patent Application No. 2014-263478 with English translation, total of 4 pages.

* cited by examiner

FIG.4
| | low humidity | | normal humidity | | high humidity | |
|---|---|---|---|---|---|---|
| basis weight | One-sided image | Double-sided image | One-sided image | Double-sided image | One-sided image | Double-sided image |
| ~135gsm | Small | Middle | Small | Small | Small | Small |
| 136~216gsm | Middle | Large | Middle | Middle | Small | Small |
| 217~350gsm | Middle | Large | Middle | Large | Small | Small |
FIG.5A
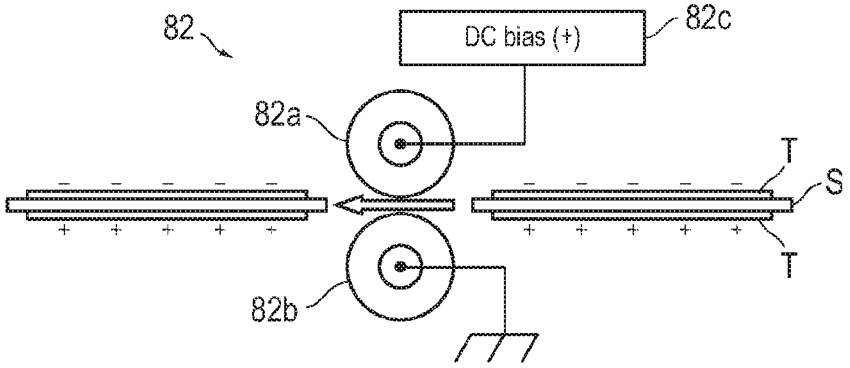
FIG.5B
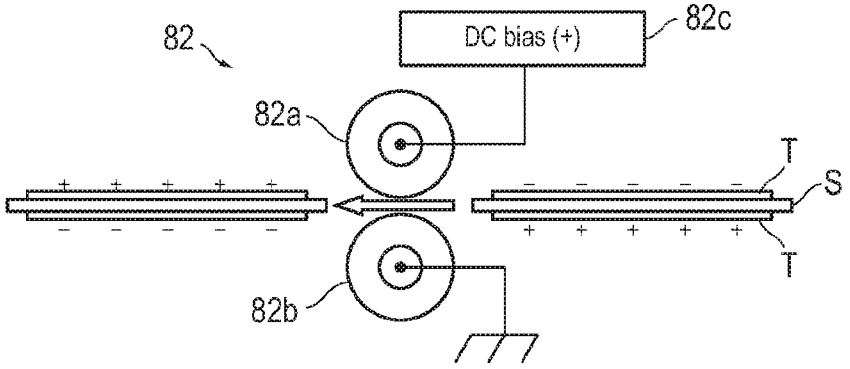

IMAGE FORMING SYSTEM, IMAGE FORMING APPARATUS, AND POST-PROCESSING APPARATUS

CROSS-REFERENCE TO RELATED APPLICATION

This application is based on Japanese Patent Application No. 2014-263478 filed on Dec. 25, 2014, the contents of which are incorporated herein by reference.

BACKGROUND

1. Technical Field

The present invention relates to an image forming system, an image forming apparatus, and a post-processing apparatus.

2. Description of Related Arts

When papers with images formed by an image forming apparatus are stacked in a post-processing apparatus or a stacker apparatus, the papers may adhere to one another by electrostatic force among them.

In this regard, Japanese Unexamined Patent Application Publication No. H10-181969 discloses a technology of performing static elimination of a paper with a formed image by performing corona discharge on the paper. Furthermore, Japanese Unexamined Patent Application Publication No. 2004-10240 discloses a technology in which a plurality of static eliminating brushes are arranged on a paper conveyance path and static elimination of a paper is repeatedly performed.

However, the water content of a paper with an image formed by an image forming apparatus is reduced by a fixing process of a toner image, so that electric resistance of the paper becomes large and charge is difficult to move. Therefore, although corona discharge has been performed on the paper, it is not possible to sufficiently eliminate charge on the paper due to the influence of discharge unevenness. Furthermore, a static elimination effect by the static eliminating brushes is small and therefore, although the static elimination by the static eliminating brushes has been repeatedly performed, a sufficient static elimination effect is not obtained.

Consequently, with respect to papers with images formed by the image forming apparatus, it is desired to reliably prevent adhesion of the papers due to electrostatic force.

SUMMARY

The present invention has been accomplished in view of the above problem. Accordingly, objectives of the present invention are to provide an image forming system, an image forming apparatus, and a post-processing apparatus, which are capable of reliably preventing recording sheets such as papers from adhering to one another due to electrostatic force.

In order to achieve at least one of the aforementioned objectives, an image forming system, reflecting one aspect of the present invention, is an image forming system including an image forming apparatus and a post-processing apparatus connected to the image forming apparatus, wherein the image forming apparatus includes a fixing unit configured to heat and press a recording sheet with a transferred toner image to fix the toner image to the recording sheet, and the post-processing apparatus includes a humidifying unit configured to humidify the recording sheet with the toner image fixed by the fixing unit, and a voltage applying unit configured to apply a bias voltage to the recording sheet humidified by the humidifying unit.

In the aforementioned image forming system, preferably, the post-processing apparatus further includes a first sheet conveyance path with the humidifying unit, a second sheet conveyance path configured to bypass the humidifying unit, and a conveyance path switching unit configured to switch the first sheet conveyance path and the second sheet conveyance path.

Preferably, the aforementioned image forming system further includes a sheet determination unit configured to determine whether the recording sheet is a coated paper, and a conveyance path control unit configured to control the conveyance path switching unit such that the recording sheet is conveyed through the first sheet conveyance path when it is determined that the recording sheet is the coated paper, and control the conveyance path switching unit such that the recording sheet is conveyed through the second sheet conveyance path when it is determined that the recording sheet is not the coated paper.

Preferably, the aforementioned image forming system further includes a coverage determination unit configured to determine whether coverage, which is a ratio of an area of the toner image with respect to an area of the recording sheet, is equal to or more than a predetermined value when it is determined that the recording sheet is not the coated paper, and a first voltage control unit configured to control the voltage applying unit to be in an ON state such that the bias voltage is applied to the recording sheet when it is determined that the coverage is equal to or more than the predetermined value, and control the voltage applying unit to be in an OFF state such that the bias voltage is not applied to the recording sheet when it is determined that the coverage is smaller than the predetermined value.

Preferably, in the aforementioned image forming system, the voltage applying unit applies the bias voltage to the recording sheet so as to eliminate charge on the recording sheet.

Preferably, the aforementioned image forming system further includes a second voltage control unit configured to switch an ON state and an OFF state of the voltage applying unit whenever one recording sheet passes through the voltage applying unit, when a plurality of recording sheets continuously pass through the voltage applying unit, to adjust charged states of the recording sheets such that polarities of opposite surfaces of the recording sheets overlapping one another after discharge from the post-processing apparatus are equal to one another.

Preferably, in the aforementioned image forming system, the voltage applying unit is configured by a pair of conductive rubber rollers to which a predetermined voltage is applied.

Preferably, the aforementioned image forming system further includes a humidifying amount control unit configured to control a humidifying amount of the recording sheet by the humidifying unit on the basis of at least one of surface information indicating whether a side of the recording sheet, to which the toner image is fixed, is both sides or one side, basis weight information indicating a basis weight of the recording sheet, and environmental information indicating an ambient environment of a place where the image forming apparatus has been installed.

The objectives, features, and characteristics of this invention other than those set forth above will become apparent from the description given herein below with reference to preferred embodiments illustrated in the accompanying drawings.

BRIEF DESCRIPTION OF THE DRAWINGS

FIG. 4 is a diagram showing a relation among basis weight information, surface information, humidity information, and a humidifying amount.

FIGS. 5A and 5B are diagrams for explaining a voltage applying process according to a modification.

DETAILED DESCRIPTION

The embodiments of this invention will be described below with reference to the accompanying drawings.

Figure 1:
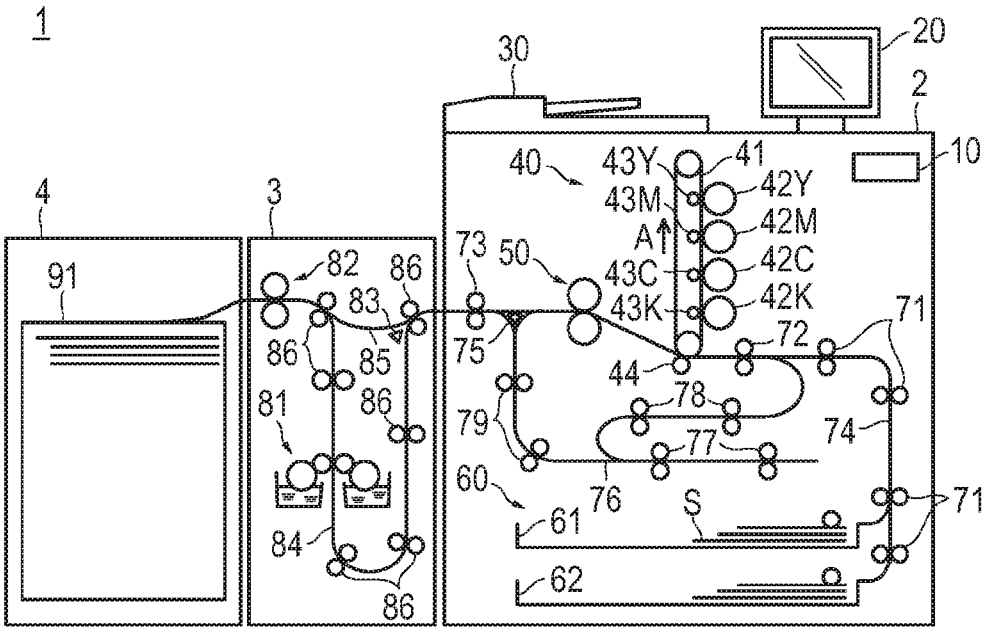
FIG. 1 is a diagram showing the schematic structure of an image forming system according to an embodiment of the present invention.

FIG. 1 is a diagram showing the schematic structure of an image forming system 1 according to an embodiment of the present invention.

As shown in FIG. 1, the image forming system 1 includes an image forming apparatus 2 that forms an image on a paper, a post-processing apparatus 3 that performs static elimination of the paper with the image formed by the image forming apparatus 2, and a stacker apparatus 4 that accumulates the paper with the image formed by the image forming apparatus 2. The image forming apparatus 2, the post-processing apparatus 3, and the stacker apparatus 4 are sequentially connected to one another from an upstream side to a downstream side of paper conveyance. Hereinafter, the following description will be given in sequence of the image forming apparatus 2, the post-processing apparatus 3, and the stacker apparatus 4.

<Image Forming Apparatus>

The image forming apparatus 2 includes a control unit 10, an operating panel unit 20, an image reading unit 30, an image forming unit 40, a fixing unit 50, and a paper feeding unit 60.

The control unit 10 includes CPU (Central Processing Unit) and various memories, and performs the control of the aforementioned each unit and various calculation processes according to a program.

The operating panel unit 20 includes a touch panel, a numeric keypad, a start button, a stop button and the like, and is used for the display of various types of information and the input of various instructions. The image reading unit 30 reads an image of a document and generates image data.

The image forming unit 40 forms an image based on various pieces of data on a paper S by using a well-known image creating process such as an electrophotographic process. A transfer belt 41 is arranged at a center part of the image forming unit 40. The transfer belt 41 is rotationally driven in a direction indicated by an arrow A, and a toner image formed on the surface of a photosensitive drum (not shown) is primarily transferred onto the transfer belt 41. Then, the toner image primarily transferred onto the transfer belt 41 is secondarily transferred to the paper S.

At a lateral side of the transfer belt 41, four image creating units 42Y, 42M, 42C, and 42K (hereinafter, indicated by 42 by simplifying reference numerals) are arranged in sequence of yellow (Y), magenta (M), cyan (C), and black (K) colors from an upper side. Each image creating unit 42 has a photosensitive drum. Around each photosensitive drum, a charging device for uniformly charging the surface of the photosensitive drum, an exposure device for forming an electrostatic latent image corresponding to image data on the uniformly charged surface of the photosensitive drum, and a development device for developing the electrostatic latent image into a toner image are arranged.

Furthermore, primary transfer rollers 43Y, 43M, 43C, and 43K (hereinafter, indicated by 43 by simplifying reference numerals) are arranged at positions facing the photosensitive drums while interposing the transfer belt 41 between the primary transfer rollers 43Y, 43M, 43C, and 43K and the photosensitive drums. The primary transfer roller 43 electrostatically attracts the toner image formed on the surface of the photosensitive drum, and primarily transfers the toner image onto the transfer belt 41.

Below the transfer belt 41, a secondary transfer roller 44 is arranged. The secondary transfer roller 44 secondarily transfers the toner image formed on the transfer belt 41 to the conveyed paper S. When the secondary transfer is performed, a high positive transfer voltage is applied to the secondary transfer roller 44, so that the negatively charged toner image is electrostatically attracted to the paper S. The paper S with the transferred toner image is supplied to the fixing unit 50.

The fixing unit 50 heats and presses the toner image transferred onto the paper S by a fixing roller, thereby fixing the toner image to the paper S. The paper S with the toner image fixed by the fixing unit 50 is supplied to the post-processing apparatus 3.

The paper feeding unit 60 accommodates the paper S as a recording sheet to be used in printing. In the paper feeding unit 60, paper feeding cassettes 61 and 62 of a two-stage configuration are detachably arranged. The paper feeding cassettes 61 and 62, for example, accommodate plain papers and coated papers, respectively.

A paper conveyance path 74 from the paper feeding cassettes 61 and 62 to the post-processing apparatus 3 is provided via an intermediate conveying roller 71, a resist roller 72, the secondary transfer roller 44, the fixing unit 50, and a paper discharge roller 73.

Furthermore, above the paper feeding cassettes 61 and 62, an inversion conveyance path 76, which is branched from the paper conveyance path 74 via a switching gate 75 at the downstream side of the fixing unit 50 and merged into the paper conveyance path 74 immediately before the resist roller 72 positioned at the upstream side of the image forming unit 40 in the paper conveyance direction, is provided. At the downstream side of the inversion conveyance path 76, an ADU (Automatic Double-sided Unit) inverting roller 77 and an ADU intermediate conveying roller 78 are provided to invert the front and the back of the paper S and convey the paper S to the downstream side of the inversion conveyance path 76.

Furthermore, on the inversion conveyance path 76 positioned directly under the paper conveyance path 74 from the fixing unit 50 to the paper discharge roller 73, conveying and inverting rollers 79 are arranged to invert the front and the back of the paper S conveyed from the fixing unit 50 and convey the paper S to the paper discharge roller 73.

<Post-Processing Apparatus>

The post-processing apparatus 3 includes a humidifying unit 81, a voltage applying unit 82, and a conveyance path switching unit 83.

The humidifying unit 81 humidifies the paper S with the image formed by the image forming apparatus 2. The humidifying unit 81 includes a reservoir for storing water, and a pair of water-absorbent rollers for sucking the water stored in the reservoir and coating the water on the surface of the paper S, and humidifies the paper S with the toner image fixed by the fixing unit 50 of the image forming apparatus 2. The pair of water-absorbent rollers are configured to be approachable to/separable from each other and capable of adjusting the humidifying amount of the paper S by adjusting a nip width.

The voltage applying unit 82 applies a bias voltage to the paper S with the fixed toner image. The voltage applying unit 82 includes a pair of conductive rubber rollers to which a predetermined voltage is applied, and applies a voltage to the paper S that passes through between the conductive rubber rollers. Between the pair of conductive rubber rollers, one conductive rubber roller is connected to a power source that applies the bias voltage and the other conductive rubber roller is grounded.

The conveyance path switching unit 83 switches a conveyance path of the paper S with the fixed toner image. The post-processing apparatus 3 is provided with a first conveyance path 84 with the humidifying unit 81 and a second conveyance path 85 for bypassing the humidifying unit 81, and the conveyance path switching unit 83 switches the first conveyance path 84 and the second conveyance path 85. The paper S conveyed through the first conveyance path 84 sequentially passes through the humidifying unit 81 and the voltage applying unit 82 and is supplied to the stacker apparatus 4. The paper S conveyed through the second conveyance path 85 passes through the voltage applying unit 82 without passing through the humidifying unit 81, and is supplied to the stacker apparatus 4. The first and second conveyance paths 84 and 85 are provided with a plurality of intermediate conveying rollers 86.

<Stacker Apparatus>

The stacker apparatus 4 includes an accommodating unit 91 for loading the paper S. In the accommodating unit 91, the paper S with the image formed by the image forming apparatus 2 is sequentially supplied and stacked.

In addition, the image forming apparatus 2, the post-processing apparatus 3, and the stacker apparatus 4 may also respectively include elements other than the aforementioned elements, or a part of the aforementioned elements may not be included.

Figure 2:
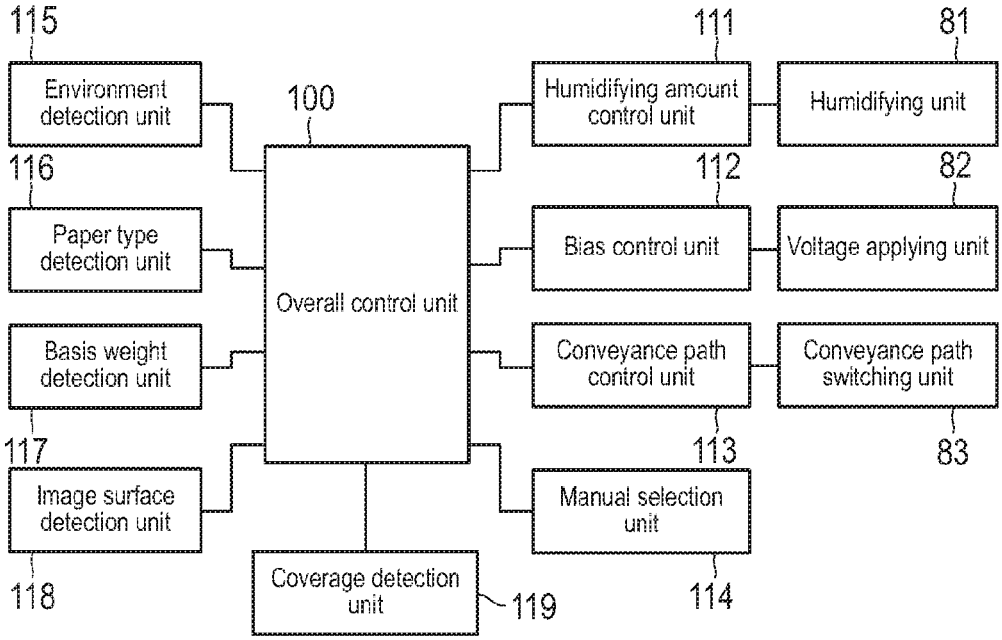
FIG. 2 is a functional block diagram for explaining a static elimination function of an image forming system.

Next, with reference to FIG. 2, the functions of the image forming system 1 will be described. FIG. 2 is a functional block diagram for explaining the static elimination function of the image forming system 1.

The image forming system 1 includes an overall control unit 100, a humidifying amount control unit 111, a bias control unit 112, a conveyance path control unit 113, a manual selection unit 114, an environment detection unit 115, a paper type detection unit 116, a basis weight detection unit 117, an image surface detection unit 118, and a coverage detection unit 119.

The overall control unit 100 controls the overall operation of the image forming system 1. The humidifying amount control unit 111 controls the humidifying unit 81 of the post-processing apparatus 3. The bias control unit 112 serves as the first and second voltage control units to control the voltage applying unit 82 of the post-processing apparatus 3. The conveyance path control unit 113 controls the conveyance path switching unit 83 of the post-processing apparatus 3. The manual selection unit 114 receives the selection of a conveyance path by a user operation.

Furthermore, the environment detection unit 115 detects ambient temperature and humidity of a place where the image forming apparatus 2 has been installed. The paper type detection unit 116 serves as a sheet determination unit to detect the type of a paper on which an image is formed by the image forming apparatus 2. The basis weight detection unit 117 detects the basis weight of the paper with the formed image. The image surface detection unit 118 detects whether the side of the paper with the formed image is both sides or one side. The coverage detection unit 119 serves as a coverage determination unit to detect coverage which is a ratio of an area of a toner image with respect to an area of a paper. In addition, the functions of the aforementioned each unit are performed when the CPU of the image forming apparatus 2 executes corresponding programs.

Next, with reference to FIG. 3, the operations of the image forming system 1 will be described. In the image forming system 1, papers with images formed by the image forming apparatus 2 are accumulated in the stacker apparatus 4 through the post-processing apparatus 3. At this time, in order to prevent adhesion of the papers stacked in the stacker apparatus 4, the static elimination of the papers is performed by the post-processing apparatus 3.

Figure 3:
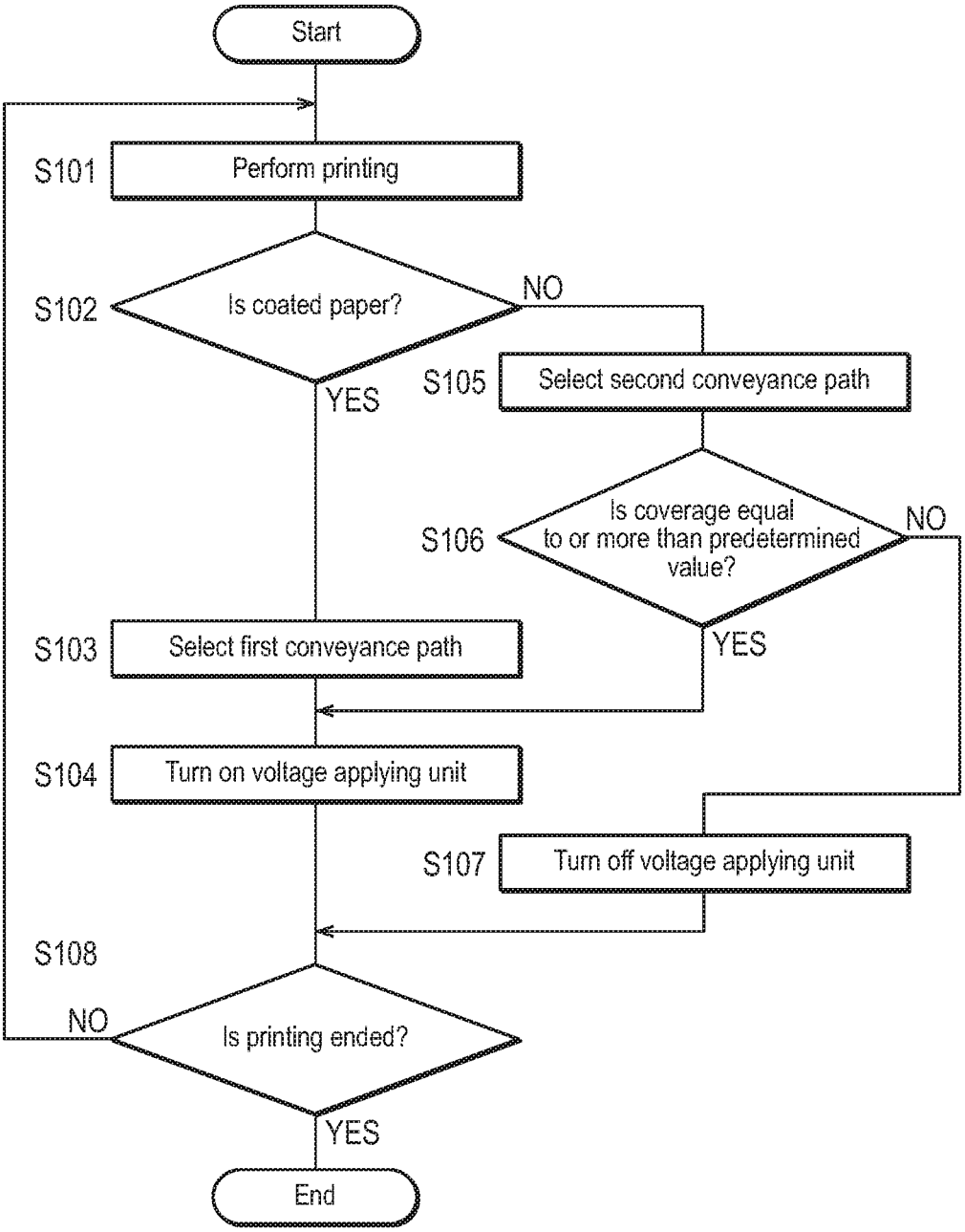
FIG. 3 is a flowchart showing the procedure of a printing process which is performed by an image forming system.

FIG. 3 is a flowchart showing the procedure of a printing process which is performed by the image forming system 1.

Firstly, the image forming system 1 performs printing for one paper (step S101). In more detail, the image forming apparatus 2 of the image forming system 1 forms an image on the one paper according to print data. The paper with the image formed by the image forming apparatus 2 is supplied to the post-processing apparatus 3. In addition, the water content of the paper with the image formed by the image forming apparatus 2 is reduced by a fixing process of a toner image and its electric resistance becomes large.

Next, the image forming system 1 determines whether the paper with the formed image is a coated paper (step S102). In more detail, the paper type detection unit 116 of the image forming system 1 determines whether the paper with the image formed in the process of step S101 is the coated paper on the basis of paper type information obtained by analyzing the print data.

When it is determined that the paper with the formed image is the coated paper (step S102: YES), the image forming system 1 selects the first conveyance path 84 (step S103). In more detail, the conveyance path control unit 113 of the image forming system 1 controls the conveyance path switching unit 83 of the post-processing apparatus 3 and selects the first conveyance path 84 with the humidifying unit 81 as a conveyance path of the paper with the image formed in the process of step S101. As a consequence, the paper is conveyed through the first conveyance path 84, so that the paper is humidified by the humidifying unit 81. The paper is humidified, so that the water content of the paper, which has been reduced by the fixing process of the toner image, increases and the electric resistance of the paper is reduced. In addition, in the present embodiment, the humidifying amount of the paper is changed according to the ambient humidity and the like of the image forming apparatus 2. A detailed description of the humidifying process by the humidifying unit 81 will be given later.

Next, the image forming system 1 controls the voltage applying unit 82 to be in an ON state (step S104). In more detail, the bias control unit 112 of the image forming system 1 controls the voltage applying unit 82 of the post-processing apparatus 3 to be in the ON state and applies a bias voltage to the paper humidified in the process of step S103. Herein, the bias voltage is a voltage for eliminating charge from the paper and its voltage value has been set in advance. The bias voltage is applied, so that the charge on the paper is eliminated.

As described above, according to the processes of steps S101 to S104 of FIG. 3, when an image has been formed on the coated paper by the image forming apparatus 2, the paper is humidified and then the static elimination is performed. According to such a configuration, the electric resistance of the paper is reduced by the humidification to allow charge to easily move and then the static elimination is performed, so that it is possible to reliably eliminate charge on the paper.

On the other hand, in the process of step S102, when it is determined that the paper with the formed image is not the coated paper (step S102: NO), the image forming system 1 selects the second conveyance path 85 (step S105). In more detail, the conveyance path control unit 113 of the image forming system 1 controls the conveyance path switching unit 83 of the post-processing apparatus 3 and selects the second conveyance path 85 for bypassing the humidifying unit 81 as the conveyance path of the paper with the image formed in the process of step S101. As a consequence, the paper is conveyed through the second conveyance path 85, and reaches the voltage applying unit 82 without being humidified.

Next, the image forming system 1 determines whether coverage is equal to or more than a predetermined value (step S106). In more detail, the coverage detection unit 119 of the image forming system 1 determines whether the coverage of the paper with the image formed in the process of step S101 is equal to or more than the predetermined value (for example, 20%) on the basis of coverage information obtained by analyzing the print data.

When it is determined that the coverage is equal to or more than the predetermined value (step S106: YES), the image forming system 1 controls the voltage applying unit 82 to be in the ON state (step S104). In more detail, the bias control unit 112 of the image forming system 1 controls the voltage applying unit 82 of the post-processing apparatus 3 to be in the ON state and applies a bias voltage to the paper for which it has been determined that the coverage is equal to or more than the predetermined value in the process of step S106. The bias voltage is applied, so that charge on the paper is eliminated.

As described above, according to the processes of steps S104 to S106 of FIG. 3, when an image has been formed on a paper (for example, a plain paper), other than the coated paper, by the image forming apparatus 2, it is determined whether the coverage of the toner image is equal to or more than the predetermined value. Then, with respect to the paper with the coverage equal to or more than the predetermined value, only static elimination is performed without performing humidification.

On the other hand, in the process of step S106, when it is determined that the coverage is smaller than the predetermined value (step S106: NO), the image forming system 1 controls the voltage applying unit 82 to be in an OFF state (step S107). In more detail, the bias control unit 112 of the image forming system controls the voltage applying unit 82 of the post-processing apparatus 3 to be in the OFF state and allows the paper, for which it has been determined that the coverage is smaller than the predetermined value in the process of step S106, to pass through the voltage applying unit 82 without applying a bias voltage.

Then, the image forming system 1 determines whether the printing has been ended (step S108). In more detail, the overall control unit 100 of the image forming system 1 determines whether the printing of all pages of the print data has been completed.

When it is determined that the printing has not been ended (step S108: NO), the image forming system 1 returns to the process of step S101. Then, the image forming system 1 repeats the processes of steps S101 to S108 until the printing of all the pages is completed.

On the other hand, when it is determined that the printing has been ended (step S108: YES), the image forming system 1 ends the procedure.

As described above, according to the processes of the flowchart of FIG. 3, when the paper with the image formed by the image forming apparatus 2 is the coated paper, the paper is humidified and then the static elimination is performed. On the other hand, when the paper with the image formed by the image forming apparatus 2 is not the coated paper, the static elimination is performed for a paper with coverage equal to or more than the predetermined value without performing humidification, and none of the humidification and the static elimination are performed for a paper with coverage smaller than the predetermined value.

As described above, according to the present embodiment, for the coated paper in which surface roughness is small and adhesion due to electrostatic force easily occurs, electric resistance of the paper is reduced by humidification and charge is allowed to easily move, and then static elimination is performed. Consequently, charge on the paper can be reliably eliminated, so that it is possible to reliably prevent adhesion of papers due to the electrostatic force.

Furthermore, for a paper in which the surface roughness is large and the adhesion due to the electrostatic force rarely occurs, other than the coated paper, no humidification is performed and static elimination is selectively performed only for a paper in which coverage is equal to or more than a predetermined value and adhesion due to electrostatic force may occur. Consequently, charge is eliminated for the paper in which the adhesion due to the electrostatic force rarely occurs, so that it is possible to more reliably prevent adhesion of papers.

Moreover, for the paper in which the surface roughness is large and the adhesion due to the electrostatic force rarely occurs, other than the coated paper, since the paper is conveyed by bypassing the humidifying unit 81, a conveyance time of the paper is shortened and the productivity of the image forming apparatus 2 is improved.

In addition, in the aforementioned printing process, when both the coated paper and the plain paper are conveyed, a paper feeding timing and an image forming timing to a paper are appropriately controlled such that a paper conveyed through the second conveyance path 85 dose not overtake a paper conveyed through the first conveyance path 84. These timings are obtained by analyzing print data.

Next, with reference to FIG. 4, the humidifying process by the humidifying unit 81 will be described in detail. In the present embodiment, on the basis of basis weight information indicating the basis weight of a paper, surface information indicating whether the side of the paper, on which an image is formed, is both sides or one side, and humidity information indicating the ambient humidity of a place where the image forming apparatus 2 has been installed, the humidifying amount of the paper is changed. The basis weight information and the surface information are obtained by analyzing print data. The humidity information is acquired through a humidity sensor (not shown) provided to the image forming apparatus 2.

FIG. 4 is a diagram showing a relation among the basis weight information, the surface information, the humidity information, and the humidifying amount. As shown in FIG. 4, in the present embodiment, the humidifying amount of a paper is set to three stages of "large", "middle", and "small" according to the basis weight information, the surface information, and the humidity information. In FIG. 4, as the basis weight is large and the humidity is low, the humidifying amount is set to be large. Furthermore, when an image forming side is both sides, the humidifying amount is set to be large as compared with the case in which the image forming side is one side. In addition, for the humidity information, humidity equal to or more than 70%, humidity smaller than 30%, and humidity equal to or more than 30% and smaller than 70% are respectively classified into "high humidity", "low humidity", and "normal humidity".

In the present embodiment, on the basis of the relation shown in FIG. 4, the humidifying amount of each paper is decided from the basis weight information, the surface information, and the humidity information. Then, the nip width of the water-absorbent roller of the humidifying unit 81 is changed according to the decided humidifying amount, and humidification corresponding to the humidifying amount is performed. According to such a configuration, it is possible to perform humidification corresponding to the charging easiness of a paper.

Furthermore, according to the present embodiment, the electric resistance of a paper is reduced by humidification to allow charge to easily move and then a bias voltage is applied to perform static elimination, so that it is possible to reliably prevent papers from adhering to one another by electrostatic force.

(Modification)

In addition, in the aforementioned embodiment, the static elimination of a paper is performed to prevent adhesion of papers due to electrostatic force. However, the charged state of a paper may also be adjusted to allow electrostatic force in a direction, in which papers repel one another, to act on, thereby preventing the adhesion of the papers.

FIGS. 5A and 5B are diagrams for explaining a voltage applying process according to a modification. In the voltage applying process according to the modification, whenever one paper passes through the voltage applying unit 82, the ON state and the OFF state of the voltage applying unit 82 are switched.

As described above, the voltage applying unit 82 includes the pair of conductive rubber rollers 82*a* and 82*b*. The conductive rubber roller 82*a* positioned on the paper S passing through the voltage applying unit 82 is connected to the power source 82*c* that applies a positive bias voltage. On the other hand, the conductive rubber roller 82*b* positioned under the paper S is grounded. In the present modification, the bias voltage applied to the conductive rubber roller 82*a* is a voltage for inverting a charged state of a paper supplied to the post-processing apparatus 3 from the image forming apparatus 2, and is set to have a voltage value higher than that of a voltage for eliminating charge on the paper.

Furthermore, as shown in FIG. 5, as the charged state of the paper S continuously supplied to the post-processing apparatus 3 from the image forming apparatus 2, the state in which the upper surface of the paper S is negatively charged and the lower surface of the paper S is positively charged is assumed. In addition, toner images T have been respectively fixed to the upper surface and the lower surface of the paper S.

In this case, if the voltage applying unit 82 is in the OFF state when the paper S passes through the voltage applying unit 82, there is no change in the charged state of the paper S before and after the paper S passes through the voltage applying unit 82 as shown in FIG. 5A. On the other hand, if the voltage applying unit 82 is in the ON state when the paper S passes through the voltage applying unit 82, the charged state of the paper S is inverted before and after the paper S passes through the voltage applying unit 82 as shown in FIG. 5B. In detail, the positive bias voltage is applied, so that the upper surface of the paper S is positively charged and the lower surface of the paper S is negatively charged. In the voltage applying process according to the present modification, whenever one paper S passes through the voltage applying unit 82, the ON state and the OFF state of the voltage applying unit 82 are switched and the charged state of the paper S is inverted for each one paper. The paper S having passed the voltage applying unit 82 is supplied to the stacker apparatus 4 and is stacked therein.

Figure 6:
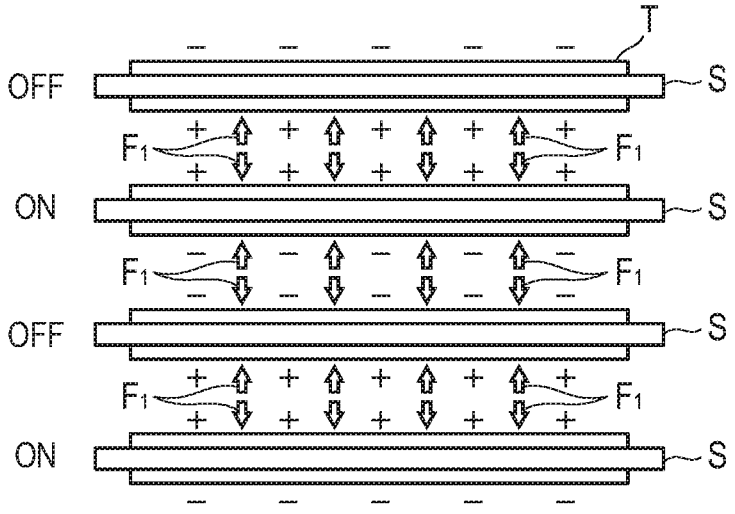
FIG. 6 is a diagram showing a charged state of papers stacked in a stacker apparatus.

FIG. 6 is a diagram showing the charged state of the papers S stacked in the stacker apparatus 4. As shown in FIG. 6, in the present modification, the opposite surfaces of the papers S stacked in the stacker apparatus 4 have the same polarity. According to such a configuration, electrostatic force $F_1$ in a direction, in which the papers S repel one another, acts on, so that the papers S do not adhere to one another.

Last, with reference to FIG. 7, a general charged state of a paper with an image formed by the image forming apparatus will be described. In the paper with the image formed by the image forming apparatus, for example, its upper surface is negatively charged and its lower surface is positively charged.

Figure 7:
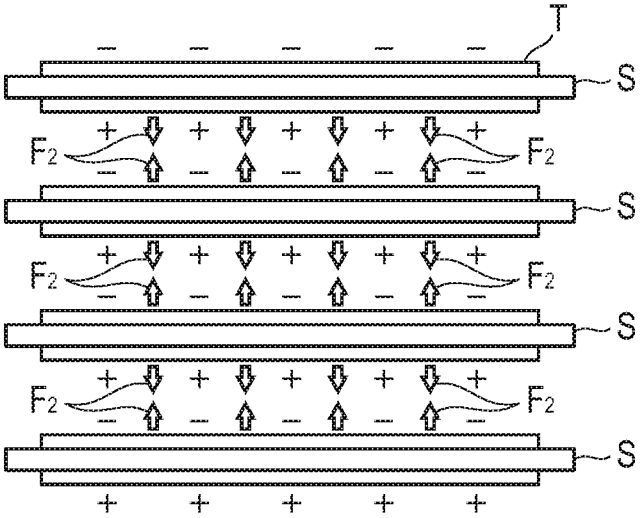
FIG. 7 is a diagram showing a charged state of papers stacked in a stacker apparatus.

Therefore, as shown in FIG. 7, when the papers S have been stacked in the stacker apparatus, the opposite surfaces of the papers S have polarities different from one another. Consequently, electrostatic force $F_2$ in a direction, in which the papers S attract to one another, acts on, so that the papers S adhere to one another. Moreover, as the number of the papers S stacked in the stacker apparatus is large, gaps among the papers S becomes small due to their own weights, so that the electrostatic force $F_2$ is enhanced. Furthermore, when the stacked paper is a coated paper with small surface roughness, the gaps among the papers S becomes small as compared with a plain paper, so that the electrostatic force $F_2$ is further enhanced. Particularly, the adhesion of the papers S due to the electrostatic force $F_2$ easily occurs in duplex printing of high coverage under the environment in which humidity is low, and causes the deterioration of handling of the papers in post-processing.

In addition, a paper with large electric resistance by a fixing process of a toner image rubs a guide plate and the like on a conveyance path and is easily and frictionally charged. In the present embodiment, a paper is humidified to reduce its electric resistance, so that the paper is also prevented from being frictionally charged at the time of conveyance.

The present invention is not limited only to the aforementioned embodiment, and can be variously modified within the scope of the accompanying claims.

For example, in the aforementioned embodiment, when a paper with a fixed toner image is a coated paper, the paper is humidified and then static elimination is performed, and when the paper with the fixed toner image is a paper other than the coated paper, the paper is not humidified and then the static elimination is performed. However, for the coated paper curled by humidification, only the static elimination may also be performed without the humidification. For a plain paper with small surface roughness, the static elimination may also be performed after the humidification. In this case, a paper conveyance path is appropriately selected by a user through a manual selection unit of the image forming system.

Furthermore, in the aforementioned embodiment, the humidifying amount of a paper is changed on the basis of three types of information of the humidity information indicating the ambient humidity of a place where the image forming apparatus has been installed, the basis weight information indicating the basis weight of a paper, and the surface information indicating whether the side of the paper, on which an image is formed, is both sides or one side. However, the humidifying amount of the paper may also be changed on the basis of one or two of the aforementioned three types of information. Alternatively, on the basis of four types of information obtained by adding temperature information indicating the ambient temperature of the place where the image forming apparatus has been installed to the aforementioned three types of information, the humidifying amount may also be changed.

Furthermore, in the aforementioned embodiment, a paper is humidified by a method for coating water on the surface of the paper by a pair of water-absorbent rollers. However, a method for humidifying the paper is not limited to the aforementioned method, and for example, misty water may also be sprayed to the paper.

Furthermore, in the aforementioned embodiment, the CPU of the image forming apparatus controls the post-processing apparatus by executing a program. However, CPU is provided to the post-processing apparatus, and the CPU of the post-processing apparatus executes a program while communicating with the CPU of the image forming apparatus, so that the post-processing apparatus may also be controlled.

Furthermore, in the aforementioned embodiment, the image forming system having the image forming apparatus and the post-processing apparatus has been described as an example. However, the post-processing apparatus may also be embedded in the image forming apparatus. In this case, the humidifying unit, the voltage applying unit, the conveyance path switching unit and the like are provided in the image forming apparatus.

The units and the methods for performing various processes in the image forming system according to the aforementioned embodiment can also be realized by any one of a dedicated hardware circuit and a programmed computer. The aforementioned program, for example, may also be provided by a computer-readable recording medium such as a flexible disk and CD-ROM (Compact Disc Read Only Memory), or may also be provided on-line via a network such as the Internet. In this case, the program recorded on the computer-readable recording medium is typically transmitted to and stored in a storage unit such as a hard disk. Furthermore, the aforementioned program may also be provided as single application software, or may also be incorporated in software of the image forming system as one function of the image forming system.

What is claimed is:

1. An image forming system comprising an image forming apparatus and a post-processing apparatus connected to the image forming apparatus, wherein the image forming apparatus comprises:

a fixing unit configured to heat and press a recording sheet with a transferred toner image to fix the toner image to the recording sheet, and the post-processing apparatus comprises:

a humidifying unit configured to humidify the recording sheet with the toner image fixed by the fixing unit, a voltage applying unit configured to apply a bias voltage to the recording sheet humidified by the humidifying unit, a first sheet conveyance path with the humidifying unit, a second sheet conveyance path configured to bypass the humidifying unit, and a conveyance path switching unit configured to switch the first sheet conveyance path and the second sheet conveyance path, wherein the voltage applying unit is disposed on a downstream side in a sheet conveying direction with respect to a point where the first sheet conveyance path and the second sheet conveyance path meet wherein the system further comprises:

a sheet determination unit configured to determine whether the recording sheet is a coated paper; and a conveyance path control unit configured to control the conveyance path switching unit such that the recording sheet is conveyed through the first sheet conveyance path when it is determined that the recording sheet is the coated paper, and control the conveyance path switching unit such that the recording sheet is conveyed through the second sheet conveyance path when it is determined that the recording sheet is not the coated paper.

2. The image forming system as claimed in claim 1, further comprising:

a coverage determination unit configured to determine whether coverage, which is a ratio of an area of the toner image with respect to an area of the recording sheet, is equal to or more than a predetermined value when it is determined that the recording sheet is not the coated paper; and a first voltage control unit configured to control the voltage applying unit to be in an ON state such that the bias voltage is applied to the recording sheet when it is determined that the coverage is equal to or more than the predetermined value, and control the voltage applying unit to be in an OFF state such that the bias voltage is not applied to the recording sheet when it is determined that the coverage is smaller than the predetermined value.

3. The image forming system as claimed in claim 1, wherein the voltage applying unit applies the bias voltage to the recording sheet so as to eliminate charge on the recording sheet.

4. An image forming system comprising an image forming apparatus and a post-processing apparatus connected to the image forming apparatus, wherein the image forming apparatus comprises:

a fixing unit configured to heat and press a recording sheet with a transferred toner image to fix the toner image to the recording sheet, and the post-processing apparatus comprises:

a humidifying unit configured to humidify the recording sheet with the toner image fixed by the fixing unit, and a voltage applying unit configured to apply a bias voltage to the recording sheet humidified by the humidifying unit, wherein the system further comprises:

a voltage control unit configured to switch an ON state and an OFF state of the voltage applying unit whenever one recording sheet passes through the voltage applying unit, when a plurality of recording sheets continuously pass through the voltage applying unit, to adjust charged states of a first sheet of the recording sheets and a second sheet of the recording sheets such that a first sheet top surface of the first sheet and a second sheet bottom surface of the second sheet both have a first polarity, and a first sheet bottom surface of the first sheet and a second sheet top surface of the second sheet both have a second polarity opposite to the first polarity, wherein the second sheet immediately follows the first sheet when passing through the voltage applying unit.

5. The image forming system as claimed in claim 1, wherein the voltage applying unit is configured by a pair of conductive rubber rollers to which a predetermined voltage is applied.

6. The image forming system as claimed in claim 1, further comprising:

a humidifying amount control unit configured to control a humidifying amount of the recording sheet by the humidifying unit on a basis of at least one of surface information indicating whether the toner image is fixed on both sides or one sideand environmental information indicating an ambient environment of a place where the image forming apparatus has been installed.

7. An image forming apparatus comprising:

a fixing unit configured to heat and press a recording sheet with a transferred toner image to fix the toner image to the recording sheet;

a humidifying unit configured to humidify the recording sheet with the toner image fixed by the fixing unit;

a voltage applying unit configured to apply a bias voltage to the recording sheet humidified by the humidifying unit;

a first sheet conveyance path with the humidifying unit;

a second sheet conveyance path configured to bypass the humidifying unit;

a conveyance path switching unit configured to switch the first sheet conveyance path and the second sheet conveyance path, wherein the voltage applying unit is disposed on a downstream side in a sheet conveying direction with respect to a point where the first sheet conveyance path and the second sheet conveyance path meet;

a sheet determination unit configured to determine whether the recording sheet is a coated paper; and a conveyance path control unit configured to control the conveyance path switching unit such that the recording sheet is conveyed through the first sheet conveyance path when it is determined that the recording sheet is the coated paper, and control the conveyance path switching unit such that the recording sheet is conveyed through the second sheet conveyance path when it is determined that the recording sheet is not the coated paper.

8. The image forming apparatus as claimed in claim 7, further comprising:

a coverage determination unit configured to determine whether coverage, which is a ratio of an area of the toner image with respect to an area of the recording sheet, is equal to or more than a predetermined value when it is determined that the recording sheet is not the coated paper; and a first voltage control unit configured to control the voltage applying unit to be in an ON state such that the bias voltage is applied to the recording sheet when it is determined that the coverage is equal to or more than the predetermined value, and control the voltage applying unit to be in an OFF state such that the bias voltage is not applied to the recording sheet when it is determined that the coverage is smaller than the predetermined value.

9. The image forming apparatus as claimed in claim 7, wherein the voltage applying unit applies the bias voltage to the recording sheet so as to eliminate charge on the recording sheet.

10. An image forming apparatus comprising:

a fixing unit configured to heat and press a recording sheet with a transferred toner image to fix the toner image to the recording sheet;

a humidifying unit configured to humidify the recording sheet with the toner image fixed by the fixing unit;

a voltage applying unit configured to apply a bias voltage to the recording sheet humidified by the humidifying unit; and a voltage control unit configured to switch an ON state and an OFF state of the voltage applying unit whenever one recording sheet passes through the voltage applying unit, when a plurality of recording sheets continuously pass through the voltage applying unit, to adjust charged states of a first sheet of the recording sheets and a second sheet of the recording sheets such that a first sheet top surface of the first sheet and a second sheet bottom surface of the second sheet both have a first polarity, and a first sheet bottom surface of the first sheet and a second sheet top surface of the second sheet both have a second polarity opposite to the first polarity, wherein the second sheet immediately follows the first sheet when passing through the voltage applying unit.

11. The image forming apparatus as claimed in claim 7, wherein the voltage applying unit is configured by a pair of conductive rubber rollers to which a predetermined voltage is applied.

12. The image forming apparatus as claimed in claim 7, further comprising:

a humidifying amount control unit configured to control a humidifying amount of the recording sheet by the humidifying unit on a basis of at least one of surface information indicating whether the toner image is fixed on both sides or one side, and environmental information indicating an ambient environment of a place where the image forming apparatus has been installed.

13. A post-processing apparatus connected to an image forming apparatus, comprising:

a humidifying unit configured to humidify a recording sheet with a toner image fixed by a fixing unit of the image forming apparatus;

a voltage applying unit configured to apply a bias voltage to the recording sheet humidified by the humidifying unit;

a first sheet conveyance path with the humidifying unit;

a second sheet conveyance path configured to bypass the humidifying unit;

a conveyance path switching unit configured to switch the first sheet conveyance path and the second sheet conveyance path, wherein the voltage applying unit is disposed on a downstream side in a sheet conveying direction with respect to a point where the first sheet conveyance path and the second sheet conveyance path meet;

a sheet determination unit configured to determine whether the recording sheet is a coated paper; and a conveyance path control unit configured to control the conveyance path switching unit such that the recording sheet is conveyed through the first sheet conveyance path when it is determined that the recording sheet is the coated paper, and control the conveyance path switching unit such that the recording sheet is conveyed through the second sheet conveyance path when it is determined that the recording sheet is not the coated paper.

14. The image forming system as claimed in claim 1, further comprising:

a humidifying amount control unit configured to control a humidifying amount of the recording sheet by the humidifying unit on a basis of at least one of: surface information indicating whether the toner image is fixed on both sides or one side; basis weight information obtained by analyzing print data for forming the toner image and indicating a basis weight of the recording sheet having the toner image fixed on the recording sheet; and environmental information indicating an ambient environment of a place where the image forming apparatus has been installed.

15. The image forming apparatus as claimed in claim 7, further comprising:

a humidifying amount control unit configured to control a humidifying amount of the recording sheet by the humidifying unit on a basis of at least one of: surface information indicating whether the toner image is fixed on both sides or one side; basis weight information obtained by analyzing print data for forming the toner image and indicating a basis weight of the recording sheet having the toner image fixed on the recording sheet; and environmental information indicating an ambient environment of a place where the image forming apparatus has been installed.

* * * * *